US005151011A

United States Patent [19]

Rezek

[11] Patent Number: 5,151,011

[45] Date of Patent: Sep. 29, 1992

[54] CEILING FAN WITH INTERCHANGEABLE BODY

[75] Inventor: Ron Rezek, Los Angeles, Calif.

[73] Assignee: Beverly Hills Fan Company, Woodland Hills, Calif.

[21] Appl. No.: 841,858

[22] Filed: Feb. 27, 1992

Related U.S. Application Data

[63] Continuation of Ser. No. 638,958, Jan. 9, 1991, abandoned.

[51] Int. Cl.[5] ..... F04D 29/64

[52] U.S. Cl. ..... 416/5

[58] Field of Search ..... 416/5, 58

[56] References Cited

U.S. PATENT DOCUMENTS

D. 82,179 9/1930 Ringwald ..... 416/5

D. 270,942 10/1983 McCain ..... 416/5

4,357,506 11/1982 Breining ..... 416/5

4,402,649 9/1983 Laurel ..... 416/5

4,884,947 12/1989 Rezek ..... 416/5

FOREIGN PATENT DOCUMENTS 4810385 4/1987 Australia .

198076 12/1905 Fed. Rep. of Germany ..... 416/5

478417 1/1938 United Kingdom ..... 416/5

*Primary Examiner*—John T. Kwon

*Attorney, Agent, or Firm*—Rothwell, Figg, Ernst & Kurz

[57] ABSTRACT

A ceiling fan has easily interchangeable top and bottom covers of glass or the like. A single nut around the fan downrod holds the top cover and a bezel held by two screws supports the bottom cover for easy exchangeability. Lights are positioned inside the covers. The covers are design coordinated.

4 Claims, 3 Drawing Sheets

FIG. 1
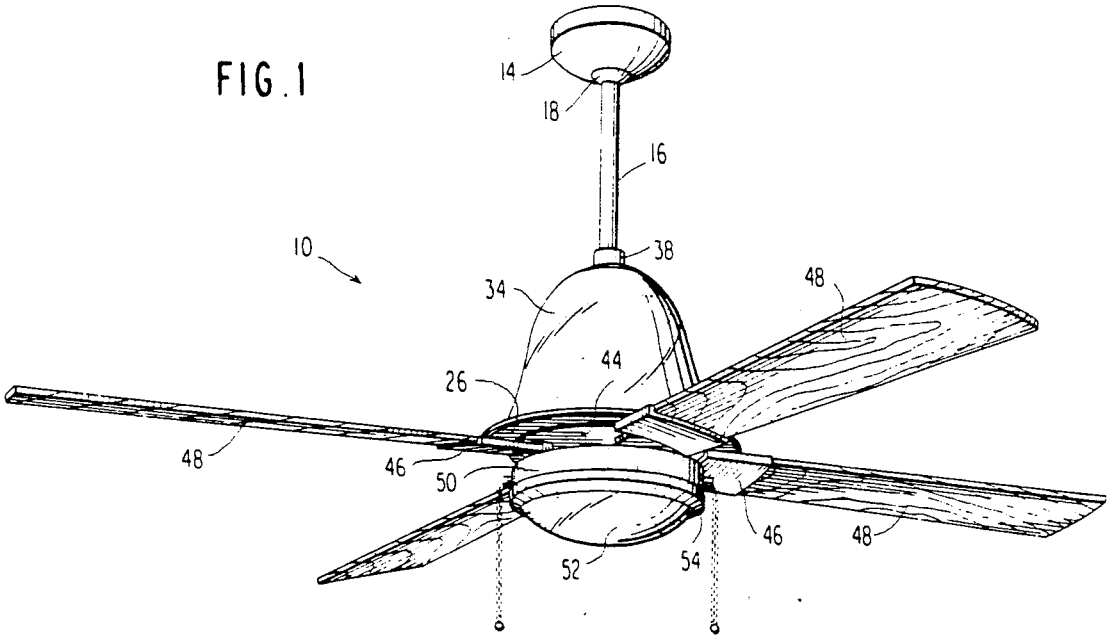
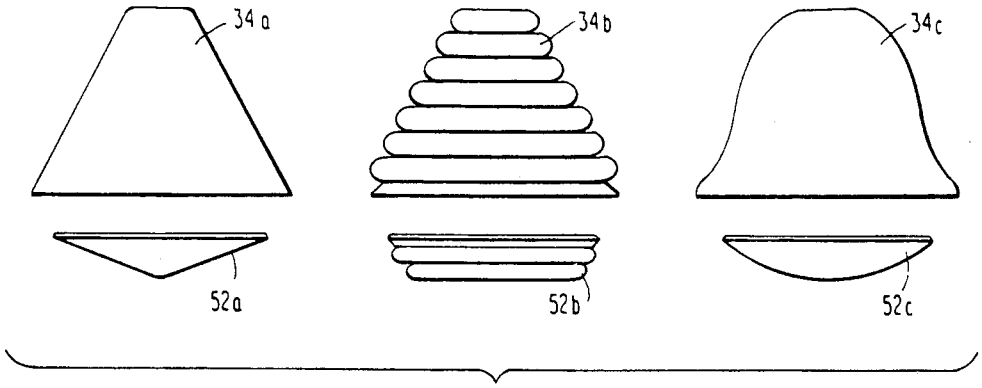
FIG. 1A

CEILING FAN WITH INTERCHANGEABLE BODY

This is a continuation of application Ser. No. 07/638,958, filed Jan. 9, 1991, now abandoned.

BACKGROUND OF THE INVENTION

1. Field of the Invention

This invention relates to improvements in ceiling fans and particularly to a unique ceiling fan having interchangeable bodies formed by easily exchangeable top and bottom covers.

2. Prior Art and Background

Ceiling fans have been known since antiquity and the advantages of ceiling fans for heating, cooling, and moving air within rooms and elsewhere is well known.

With the increased use of ceiling fans, particularly in rooms designed by high fashion interior designers, there was a need in the art to provide ceiling fans of varied design so that a designer could chose an appropriate design to fit in with the interior decor of a room bearing the fan.

High fashion fans with a single non-interchangeable housing are known, for example, the STRATOS® fan designed by Ron Rezek made according to U.S. Pat. No. 4,884,947 granted Dec. 5, 1989.

There is an additional need in the art for ceiling fans which provide some illumination to the room in which they are mounted as well as providing illumination as part of a high fashion decor. Further, there is a need in the art for high fashion designer ceiling fans with easily interchangeable body components so that a common base fan can be provided with different body components to present completely different design appearances, i.e., provide the same basic fan with interchangeable covers to meet different design requirements. Such would allow a retailer or other seller of fans to provide a large variety of fans with different appearances for customers while having a minimum of parts on hand and the same would be true for the manufacture and others in the chain of distribution.

If the need for such interchangeable appearances for ceiling fans were to be met, it should be met in such a way that the interchangeability is so simple and easy that anyone could accomplish such in a minimal period of time. It should also be done in a manner to reduce manufacturing costs.

SUMMARY OF THE INVENTION

This invention provides a ceiling fan of the type having a canopy mounted on a ceiling, a down rod supporting a fan motor, the down rod extending downwardly from the canopy, a drive motor having a stationary component supported from the downrod and a rotary component driving a fan blade support to which fan blades are affixed. To these conventional components is added a removable top cover, preferably of glass or other translucent/transparent material, positioned to cover the motor above the fan blades and a removable bottom cover, also preferably of the same material, positioned removably below the fan blades. The top and bottom covers are shaped and colored according to a complimentary or unitary design desired by the designer and are exchangeable for other units of other designs but simply removing one nut having the top cover and two screws holding the bottom cover. Additionally, and preferably, lights can be placed in the light bulb sockets on stationary components under the top and bottom covers in which case the lights illuminate the covers and provide illumination for the room but particularly provide a unique design appearance, especially if the top and bottom covers are colored or bear internal designs.

BRIEF DESCRIPTION OF THE DRAWINGS

FIG. 1 is a perspective view of the unique ceiling fan of this invention.

FIG. 1A is a simplified showing of interchangeable covers to give different appearances.

DETAILED DESCRIPTION OF THE PERFERRED EMBODIMENT

Figure 2:
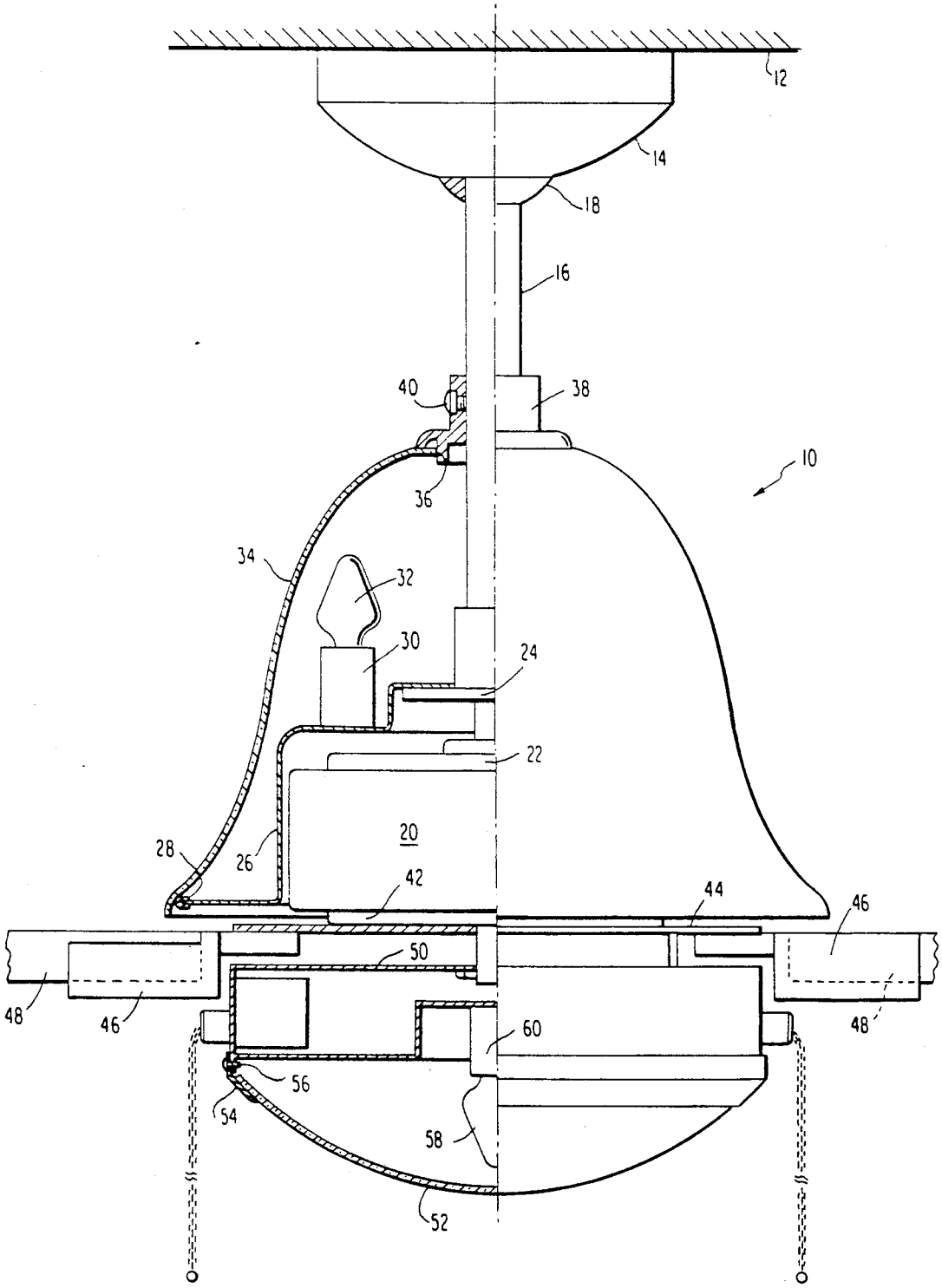
FIG. 2 is a side elevation view of the fan of this invention supported and hanging from a ceiling.
Figure 3:
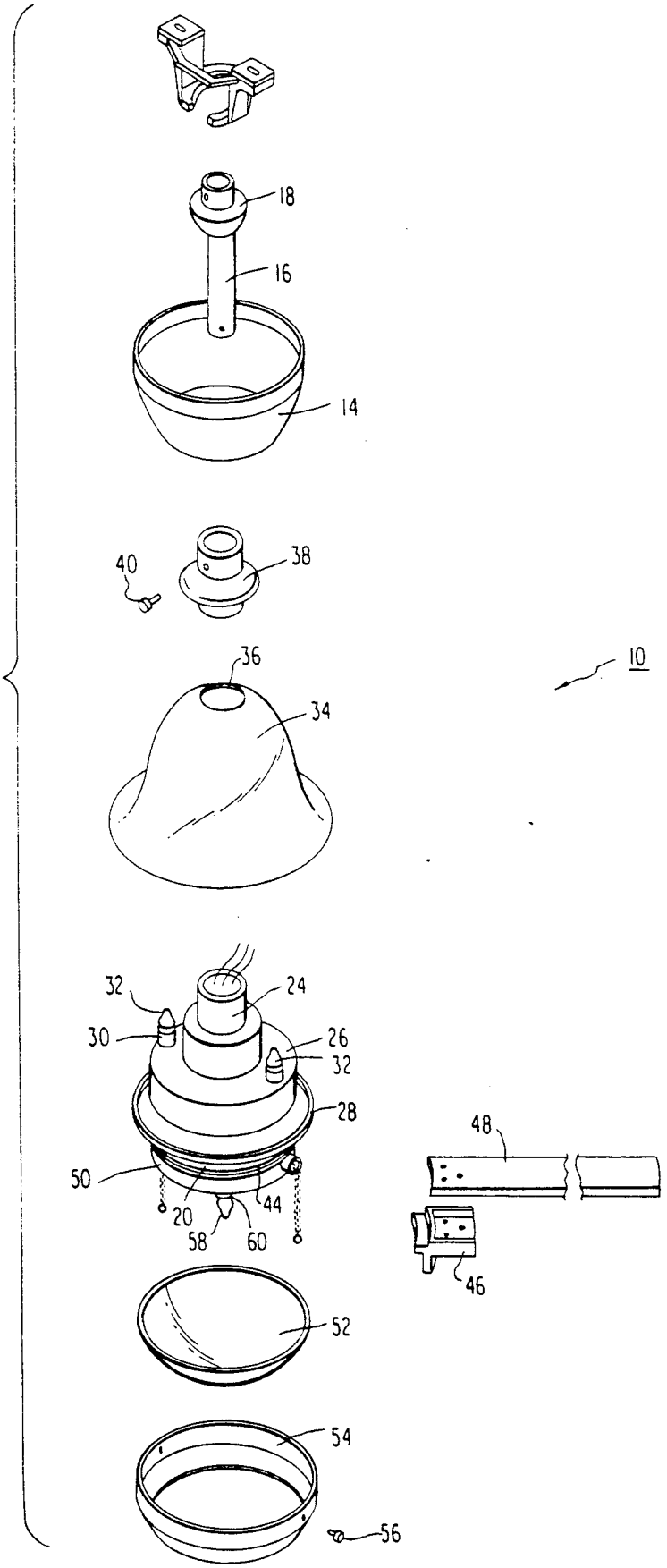
FIG. 3 is an exploded perspective view of the component parts for the fan.

As shown in FIGS. 1 and 2, a unique design of a ceiling fan 10 is supported from a top surface 12. A hanging bracked support 11 for the fan is attached to the ceiling and covered by a canopy 14. A downrod 16 has a removable hang-through ball 18 so that the fan may vertically position itself in bracket 11. The downrod is hollow in order to carry the electrical wiring and connections to drive the motor.

A drive motor assembly 20 includes a rotor 21 and a stator 22 which is supported from the downrod 16 in a conventional manner. A stationary collar 24 on the downrod carries an annular metal support ring 26 having a soft edge bumper 28. Light sockets 30 carrying light bulbs 32 are spaced around the surface of ring 26.

An interchangeable top cover 34 has a central opening 36 to accommodate the downrod 16 and a top cover holding nut 38. The top cover holding nut is held on the downrod by screw 40.

The top cover 34 is shown as bell-shaped and may preferably be a blown glass body or could be a plastic or other translucent materials to light up when illuminated from beneath.

Easy replacement of the top cover 34 is accomplished via the single nut, top nut 38, which together with bumper 28 holds the top cover in place.

The fan rotor 21 connected to drive a blade ring 44 to which blade irons 46 are attached. Blades 48 are attached to the blade irons.

Below the level of the fan and held on to a stationary support assembly 50 is a bottom cover 52 held in a spun metal bezel 54. The bezel 54 is attached to the support assembly 50 by screws 56.

Lighting of and through the bottom cover is provided by an electrical light bulb 58 positioned in socket 60.

With this invention, it is quick and easy to exchange top and bottom covers 34 and 52 to provide different appearing fans due to the shape, color, or composition of the covers. The covers are preferably coordinated with respect to design and/or color. Prior to complete assembly and installation of the fan, the covers may simply interchanged. Samples of interchangeable covers are shown in FIG. 1A.

As can be seen, this invention provides a unique arrangement for providing a large number of coordinated designs for top and bottom covers for fans to provide different looking fans simply by providing interchangeable covers, and the design effects are enhanced by interior illumination. The interchangeability of the covers prior to assembly and installation of the fan is so simple that it can be accomplished by unskilled workers in a minimal amount of time. Using glass body parts rather than metal results in a savings in cost, especially tooling costs and development costs of incorporating new shapes, embellishments or colors into the product line.

I claim:

1. In a ceiling fan of the type supported from a ceiling by stationary down rod, a stationary assembly attached to the lower end of the down rod, an electric motor supported from the stationary assembly, fan blades driven by the motor, a top cover covering the motor and at least a lower portion of the down rod, and a bottom cover supported from a stationary assembly below the fan blades with improvements comprising, the top and bottom covers being removable, replaceable and interchangeable, the top and bottom covers formed of glass or transluscent material and being of decorative shape and color, the interchangeability allowing different shapes and colors of the top and bottom covers to be utilized, bumper means on the stationary assembly for supporting a bottom edge portion of the top cover, a top nut annular member surrounding the down rod and postioned above the top cover for holding the top cover down against the stationary assembly bumper means by the top nut annular member cooperating with the top of the top cover.

2. A ceiling fan as defined in claim 1 wherein the bumer means carried by the stationary assembly beneath the top is a soft edge on a flange portion of the stationary assembly.

3. A ceiling fan as defined in claim 1 wherein the bottom cover is attached by attaching means including a bezel held to the stationary member and wherein the top annular nut is held to the down rod by a set screw.

4. A ceiling fan as defined in claim 1 further comprising illumination means beneath the top and bottom covers.

* * * * *

UNITED STATES PATENT AND TRADEMARK OFFICE

CERTIFICATE OF CORRECTION

PATENT NO. : 5,151,011

DATED : September 29, 1992

INVENTOR(S) : Ron Rezek

It is certified that error appears in the above-identified patent and that said Letters Patent is hereby corrected as shown below:

Col. 1, line 65 "but" should be --by--.

Col. 2, line 21 "bracked" should be --bracket--.

Col. 4, line 9 (claim 2) "bumer" should be --bumper--.

Signed and Sealed this

Twenty-eighth Day of September, 1993

*Attest:*

*Attesting Officer*

BRUCE LEHMAN

*Commissioner of Patents and Trademarks*